US006732743B1

(12) United States Patent
Bouix et al.

(10) Patent No.: US 6,732,743 B1
(45) Date of Patent: May 11, 2004

(54) FLOCKED COSMETIC APPLICATOR

(75) Inventors: Herve F. Bouix, New York, NY (US); Charles Neuner, Amityville, NY (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/359,950

(22) Filed: Jul. 22, 1999

(51) Int. Cl.[7] ..... A45D 24/00; A45D 40/24
(52) U.S. Cl. ..... 132/200; 132/318; 132/317
(58) Field of Search ..... 132/318, 320, 132/317, 200; 401/122, 119, 126, 129, 128, 130, 75

(56) References Cited

U.S. PATENT DOCUMENTS

| | | | | | |
|---|---|---|---|---|---|
| 3,863,654 | A | * | 2/1975 | Morane et al. | 132/293 |
| 4,767,398 | A | * | 8/1988 | Blasius | 604/1 |
| 4,915,234 | A | | 4/1990 | Boeller | |
| 5,002,415 | A | * | 3/1991 | Gueret | 401/126 |
| 5,096,319 | A | * | 3/1992 | Gueret | 401/126 |
| 5,102,248 | A | * | 4/1992 | Welschoff | 401/50 |
| 5,221,153 | A | * | 6/1993 | Spatz | 401/98 |
| 5,324,128 | A | * | 6/1994 | Gueret | 401/126 |
| 5,538,022 | A | * | 7/1996 | Bennett | 132/318 |
| 5,636,931 | A | * | 6/1997 | Gueret | 401/126 |
| 5,765,574 | A | * | 6/1998 | Sheffler et al. | 132/218 |
| 5,785,905 | A | | 7/1998 | Sheffler et al. | |
| 5,803,638 | A | * | 9/1998 | Gueret | 401/122 |
| 5,851,079 | A | * | 12/1998 | Horstman et al. | 401/174 |
| 5,899,622 | A | * | 5/1999 | Gueret | 401/122 |
| 6,010,266 | A | * | 1/2000 | Schrepf | 40/126 |
| 6,059,570 | A | * | 5/2000 | Dragan et al. | 433/80 |
| 6,070,598 | A | * | 6/2000 | Gueret | 132/320 |
| 6,071,027 | A | * | 6/2000 | Gueret | 401/75 |

FOREIGN PATENT DOCUMENTS

| | | | | |
|---|---|---|---|---|
| EP | 0526300 A1 | | 2/1993 | A01B/33/00 |
| EP | 0823228 A1 | | 2/1998 | A45D/40/26 |
| FR | 2445705 | * | 9/1980 | 401/122 |
| FR | 2752695 A1 | | 3/1998 | A45D/33/34 |
| WO | WO 96/32031 | | 10/1996 | |
| WO | WO 96/32032 | | 10/1996 | |

* cited by examiner

*Primary Examiner*—John J. Wilson
*Assistant Examiner*—Robyn Kien Doan
(74) *Attorney, Agent, or Firm*—Karen A. Lowney; Peter Giancana

(57) ABSTRACT

The invention relates to a device for sampling cosmetic materials, the device comprising a body and at least one applicator tip, the applicator tip having an application surface with flock attached thereto.

7 Claims, 2 Drawing Sheets

FLOCKED COSMETIC APPLICATOR

FIELD OF THE INVENTION

The invention relates to cosmetic applicators. More specifically, the invention relates to cosmetic applicators adapted for single or short-term use.

BACKGROUND OF THE INVENTION

Before buying a makeup product, the average consumer will most frequently wish to try the product she is contemplating on her own skin before committing to make what may be an expensive purchase. In order to please the potential buyer, the cosmetics vendor faces a difficult dilemma. i.e., how to permit the buyer to sample a small amount of the product of interest at a relatively low cost to the vendor, and at the same time provide the buyer with an adequate amount of product to permit her to make an informed decision regarding her purchase. For many years, the standard procedure was providing an array of "testers", i.e., full size pieces of each color in a line. In this scenario, every prospective buyer sampled from the same piece, such as a full size lipstick. Because there was a single piece to test from, however, and particularly with lipstick, no buyer was actually permitted to apply the product directly to her lips; rather, at best it was permitted to stroke the lipstick on the skin of the back of the hand. Alternately, for example, with a powder product such as an eyeshadow, an individual cotton swab might be provided to each customer, to permit her to take a small amount from the single piece provided. Clearly, however, such sampling procedures are less than optimum for the consumer, as they do not permit normal application and evaluation of the appearance of the product in the environment in which they will be worn.

It has now become a more common practice to provide the customer with individual single or short term use samplers, i.e., a miniature version of the actual full size product. The individual sampler is completely hygienic, being used by a single customer, and allows the customer to try a lipstick directly on her lips at the counter, or to take it home to try it with a particular outfit. The single use tester has now become an established method of sampling, being preferable to both the vendor and the customer as a means of trying out a new product. Illustration of such testers are found for example in U.S. Pat. Nos. 5,785,905, 4,915,234, WO 96/32031 and WO 96/32032. However, such testers are not without their problems. Unlike the full-size testers, the vendor must have a large inventory of samples of each shade on hand at the counter, thus creating a potential storage problem in a small space. It can also be costly to create a variety of samplers in all available shades, for which there may not be equal demand, potentially leaving a considerable amount of waste of less popular sampler shades. In addition, many of the cosmetic products currently available rely on the use of volatile solvents; such products, in order to be stored over long periods of time, require airtight packaging, which can significantly increase the cost. Thus, there continues to be a need for a cosmetic sampler that affords the consumer a convenient means of trying new products under hygienic conditions, while at the same time being cost-effective and efficiently storable by the vendor. The present invention now provides such a product.

SUMMARY OF THE INVENTION

The present invention relates to a cosmetic sampler, the sampler comprising a body and at least one applicator attached to the body tip, the tip having flock applied thereto. The flock provides a surface on the applicator portion to which a cosmetic product, in an amount sufficient for one or two applications, can be applied. Optionally, the sampler is additionally provided with a cap, which, when fitted onto the body, may provide either an ordinary or an airtight seal.

DETAILED DESCRIPTION OF THE INVENTION

The sampler of the present invention is designed so as to permit ease of storage at the cosmetics counter without the need for maintaining a full inventory of samplers in all shades of a cosmetics line. The sampler is provided to the counter empty, i.e., without any product on the sampler. When a customer expresses interest in a particular shade, the beauty advisor simply applies the product of interest, by rubbing it against the flocked surface of the applicator tip. The flock holds enough product for one or two applications of the product.

Figure 1:
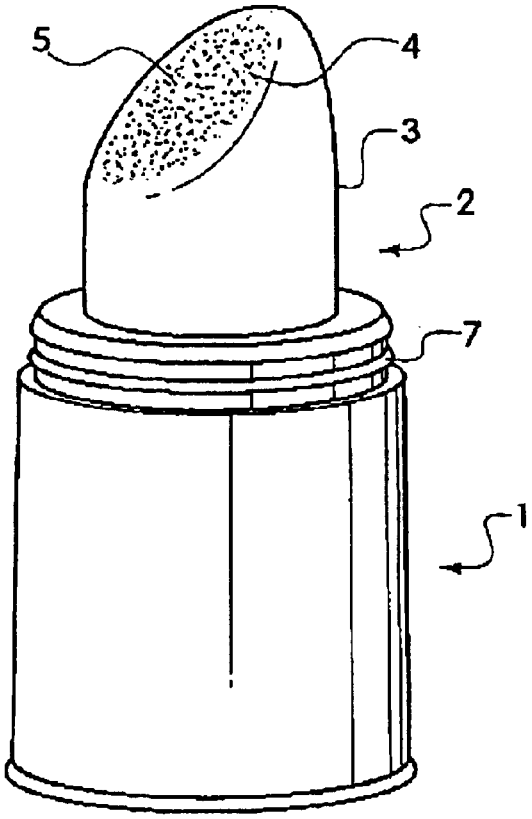
FIG. 1 illustrates a front view of a sampler of the invention, without a cap.

The structure of the sampler is fairly simple, and inexpensive to manufacture. As shown in FIG. 1, the sampler comprises two distinct regions, a body 1, and the applicator region 2 which comprises at least one applicator tip 3, attached to the body, the tip having an application surface 4, i.e., the portion of the tip 3 which is particularly shaped and adapted for application of the product. For ease of illustration, the applicator tip 3 is shown in the shape of a lipstick bullet; however, it will be understood that the tip 3, and the application surface 4, may be in any shape which permits ease of application of flock to its surface, and which further permits ease of application of the product of interest to the area of the face or body to which the user wishes to apply it. For example, the shape of the tip as a whole may be, in cross section, round, rectangular, hexagonal, triangular or any such variation, The application surface of the tip can be oval-, round-, teardrop-, heart-, square-shaped, or any other variation which permits application of the makeup product to the skin surface. Similarly, the body can also be formed in any shape, and will normally, but not necessarily, be of the same shape as the tip; however, a cylindrical body is preferred. It will readily be recognized that the sampler may possess more than one applicator tip, which permits sampling of more than one cosmetic product at a time.

The body 1 and applicator tip 3 of the sampler can be conveniently made by injection molding of a plastic, such as polypropylene or polyethylene terpthalate. Once the sampler is molded, flock 5 is applied to the applicator tip 3. It is of course possible to apply flock 5 to the entire tip 3, but preferably, the flock is applied only to the application surface 4. The process of flocking is a standard one, well known in the art. Briefly, short fibers, which may be of any commonly used material, such as nylon, polyester, or any natural fiber are applied with an adhesive, such as an epoxy, to the surface to be flocked. Preferably, the flocking process takes place in an electrostatic field, which results in the proper orientation of the fibers. The flock on the application surface provide a convenient "reservoir" which can hold a small amount of cosmetic product adequate for one or two applications. The product is loaded onto the flocking by simple rubbing of the product against the flock.

Figure 2:
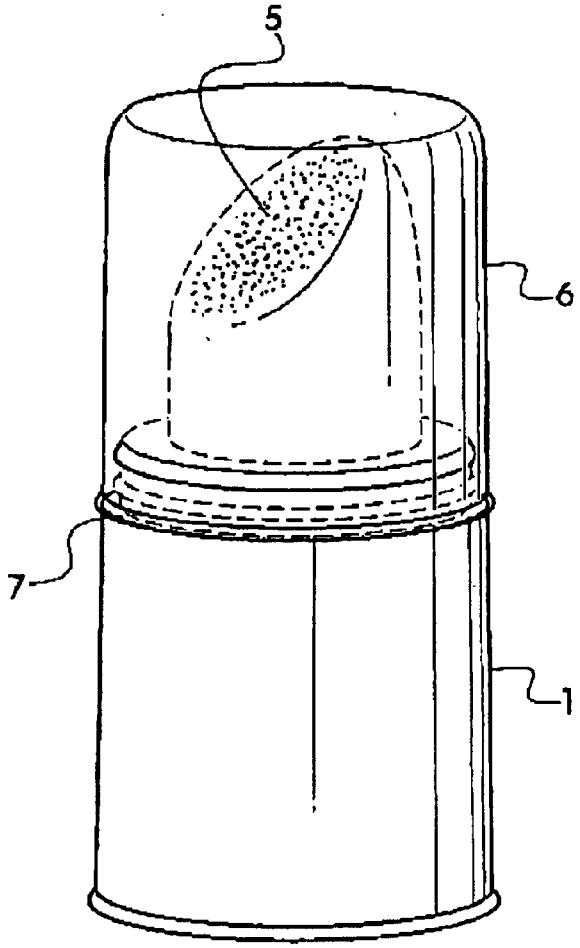
FIG. 2 illustrates a front view of the sampler with a cap in place.
Figure 3:
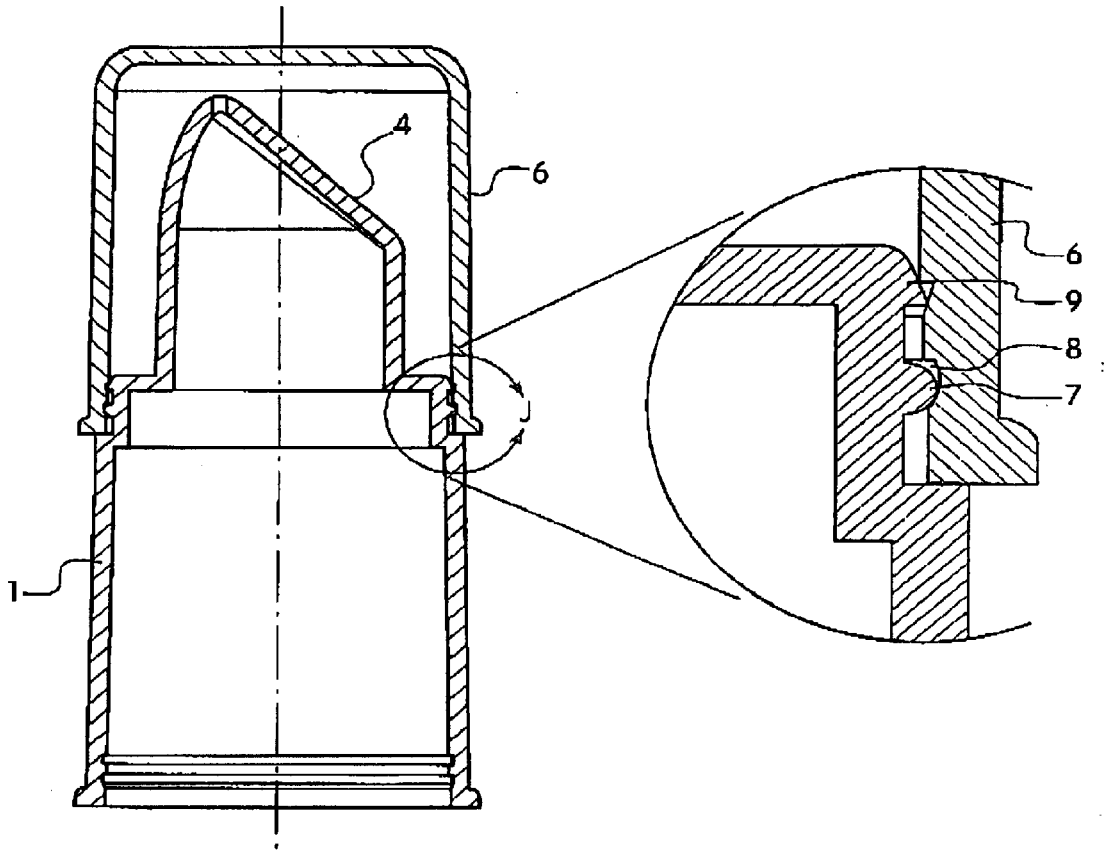
FIG. 3 illustrates an axial section through the sampler with a cap in place, with a detailed view of articulation of the cap with the body.

In one embodiment, and as shown in FIG. 2, the sampler is provided with a cap 6, to enclose the applicator tip which has been loaded with product. If the sampler is to be used right at the cosmetics counter, a cap is not essential, as the sampler will be immediately used and disposed of. However, if the customer wishes to take the sampler elsewhere to try, it is important to provide a cap to preserve the product on the flock. The cap 6, which can also be formed by injection molding, may be of an ordinary type, for example, one which simply fits onto the body 1 by way of a friction-fit. In a preferred embodiment, however, particularly when the cosmetic product has been formulated with a volatile solvent, the cap 6 forms an airtight seal against the body of the sampler. This may be achieved by any means known in the art, such as by dimensioning the cap 6 so as to provide a volatile-impervious seal, providing a flexible gasket between the cap and body, or providing a flexible sleeve to provide the necessary seal. For ease of manufacture and economy, however, the seal can be accomplished by providing a sealing rib 7 on the body of the sampler, which rib will fit into a corresponding internal annular groove 8 on the cap 6, securing the cap 6 in place on the body. The sealing rib 7 may be further supplemented by the presence of an additional annular projection 9 on the body, preferably situated at the upper end of the body 1 above the sealing rib 7, which projection 9 contacts the inner wall of the cap 6, preferably along the entire circumference of the cap 6, thereby providing an additional barrier to the entry of air into the chamber enclosed by the cap 6.

The sampler of the invention is particularly well adapted for use in providing samples of lipstick, lip gloss, or other lip products. However, its use is not limited in this way, and the sampler may also be used for sampling eyeshadows, blushes, eyebrow products, foundations, face powders, skin care products, and the like, i.e., any type of product that can be conveniently transferred to and held by the flock on the application surface. The use of the sampler is very simple, in that the user simply rubs the flocked application surface against the portion of the face or body on which she wishes to try the product.

The sampler not only provides a great benefit to the end user, but also provides numerous advantages to the vendor dispensing cosmetic samples. For example, the sampler is completely hygienic: each user receives her own sampler, which has not previously been used by anyone else, and which is customized according to her needs. It also benefits the vendor in that it can be shipped and stored conveniently, in bulk, unloaded, to the counter where it will be used. It is therefore unnecessary to retain numerous samplers of each shade or product carried, because a single, normal size product of any given shade can be used to load the sampler on an as-needed basis, thereby eliminating waste due to overstocking of samplers of less popular shades. The sampler is also inexpensive to make, and gives the consumer adequate product to try, while at the same time avoiding the need on the part of the vendor to dispense large quantities of promotional materials at no charge.

What we claim is:

1. A method of using a cosmetic sampler, comprising:

providing an elongated device comprising a hollow body and at least one applicator tip attached to the body, the applicator tip having an application surface with flock attached thereto, wherein, at least a portion of the application surface is flat, the flat portion being oriented obliquely to the longitudinal axis of the device; and loading the cosmetic material onto the applicator tip by rubbing the cosmetic material and the flock against each other.

2. The method of claim 1 further comprising the step of placing a cap on the body.

3. The method of claim 2 in which the cap forms an airtight seal with the body.

4. The method of claim 3 in which the cap comprises an internal groove.

5. The method of claim 4 in which the body is equipped with a sealing rib.

6. The method of claim 5 in which the sealing rib fits into the internal groove on the cap.

7. A method of sampling a cosmetic material, comprising:

providing an elongated device comprising a hollow body and at least one applicator tip attached to the body, the applicator tip having an application surface with flock attached thereto, wherein, at least a portion of the application surface is flat, the flat portion being oriented obliquely to the longitudinal axis of the device;

loading the cosmetic material onto the applicator tip by rubbing the cosmetic material and the flock against each other; and contacting the applicator tip on a body.

* * * * *